US005421586A

United States Patent [19]

Amram et al.

[11] Patent Number: 5,421,586

[45] **Date of Patent: * Jun. 6, 1995**

[54] GOAL NET

[75] Inventors: Roger Amram, Willowdale; Michael Lamarche, Orillia, both of Canada

[73] Assignee: Fun Bunch Inc., Willowdale, Canada

[ * ] Notice: The portion of the term of this patent subsequent to Sep. 13, 2011 has been disclaimed.

[21] Appl. No.: 229,629

[22] Filed: Apr. 14, 1994

Related U.S. Application Data

[63] Continuation of Ser. No. 48,216, Apr. 20, 1993, Pat. No. 5,346,227.

[51] Int. Cl.[6] ..... A63B 63/00

[52] U.S. Cl. ..... 273/400; 273/407; 273/127 B

[58] Field of Search ..... 273/400, 395, 401, 411, 273/422, 407, 410, 127 B

[56] References Cited

U.S. PATENT DOCUMENTS

| | | | |
|---|---|---|---|
| 3,475,025 | 10/1969 | Uphaus | 273/25 |
| 4,083,461 | 4/1978 | Daffer, Jr. | 273/103 |
| 4,169,598 | 10/1979 | Taylor | 273/127 |
| 4,339,132 | 7/1982 | Stevens et al. | 273/400 |
| 4,420,158 | 12/1983 | Klock et al. | 273/400 |
| 4,702,478 | 10/1987 | Kruse | 273/127 |
| 4,842,284 | 6/1989 | Rushing et al. | 273/395 |
| 4,846,205 | 7/1989 | Knoll | 135/106 |
| 5,080,375 | 1/1992 | Moosavi | 273/400 |
| 5,244,213 | 9/1993 | Armell | 273/400 |

FOREIGN PATENT DOCUMENTS

| | | | |
|---|---|---|---|
| 1180727 | 1/1985 | Canada | 273/127 |
| 1214802 | 12/1986 | Canada | 273/127 |
| 176317A1 | 4/1986 | European Pat. Off. | A63B 63/00 |
| 2485379 | 12/1981 | France | A63B 63/00 |

*Primary Examiner*—Mark S. Graham
*Attorney, Agent, or Firm*—Mark B. Eisen

[57] ABSTRACT

A collapsible, portable goal net for sports comprises a frame consisting of tubular components coupled together, with an elastic cord running through the components to retain a flexible connection between the components even when they are uncoupled to collapse the net. A flexible mesh is provided with sleeves composed of a less flexible material than the mesh, for affixing the mesh to the frame. The components of the frame can slide freely in the sleeves, thus preventing the mesh from becoming caught or entangled in the detached joints when the net is collapsed.

13 Claims, 5 Drawing Sheets

FIG. 3.
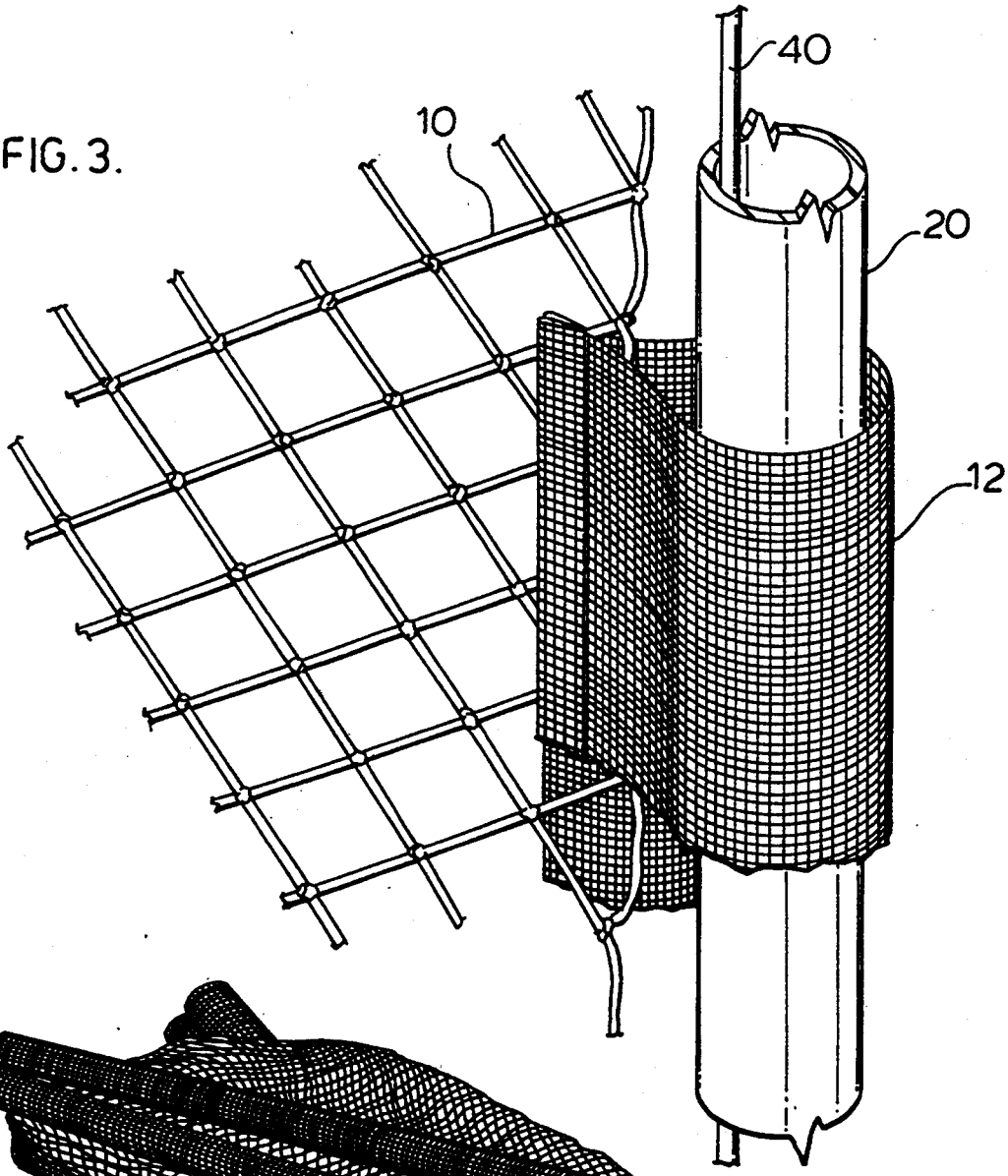
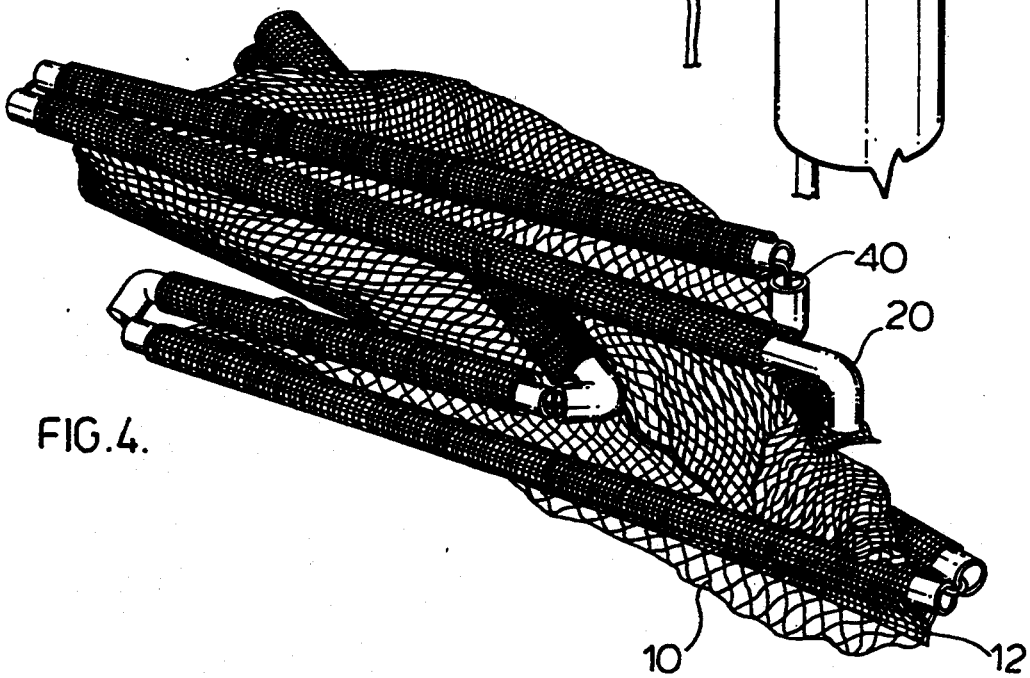
FIG. 4.

GOAL NET

This is a continuation of U.S. patent application Ser. No. 08/048,216, filed Apr. 20, 1993, U.S. Pat. No. 5,346,227.

FIELD OF INVENTION

This invention relates to goal nets. In particular, this invention relates to a collapsible, portable goal net for sports.

BACKGROUND OF THE INVENTION

Sports which involve the use of a goal net, such as hockey, soccer and many others, are popular in many parts of the world. In general, the object in such games is to impel a ball, puck or other object into an area defined as the goal. The goal net is essentially a framed backstop which captures the object when a goal has been scored.

Such sports activities are played both in organized leagues and informally. Using hockey as an example, the sport is played by professionals and schoolchildren alike. Variations on the basic game of ice hockey have also become popular, such as field hockey, floor hockey and ball hockey, to name a few. In all cases, unless the game is being played at an arena specifically designed for the sport, it is necessary for the players to provide goal nets.

It is thus advantageous to provide some measure of portability in a goal net. A typical goal net comprises a tubular metal frame to which is tied a flexible mesh. The frame tends to be rather heavy and therefore difficult to carry. Even where a light metal such as aluminum is used, the goal net is awkward to carry because of its size and shape. It is necessary to use a strong, rigid material for the frame, to withstand the rigours of the sport, and it is impractical to untie and retie the mesh, which would be required to disassemble the frame, every time the goal net needs to be transported.

This invention solves these problems by providing a goal net with a frame composed of several connected tubes which can be uncoupled without becoming completely detached, and without the need to remove the mesh from the frame, thereby maintaining the integrity of the goal net even when collapsed. The goal net can thus be collapsed for transport and then quickly and easily erected at the desired location.

This is accomplished by providing an elastic cord running through the components of the frame, and providing the edges of the mesh with sleeves through which the tubes of the frame are disposed. The elastic cord keeps the components of the frame in the proper arrangement when the frame is collapsed, because the components remain flexibly connected even though adjoining tubes have been uncoupled from one another. Sleeves joining the mesh to the frame keep the mesh from becoming entangled in the uncoupled joints of the frame and from getting caught on the tube connectors as the goal net is erected.

SUMMARY OF THE INVENTION

The present invention thus provides a collapsible goal net comprising a frame having a crossbar supported by posts and a bottom rail connected to each post, an elastic cord connecting components of the frame, and a mesh provided with sleeves for affixing the mesh to components of the frame, whereby adjoining components of the frame are rigidly connected when coupled together and can be uncoupled while the elastic cord retains a flexible connection between adjoining components.

The present invention further provides a kit of parts for constructing a goal net, including a crossbar, posts, and a bottom rail for forming a frame, a mesh provided with sleeves sized to fit the components of the frame, and a cord for joining the components of the frame.

The present invention further provides a collapsible goal net comprising a frame having a crossbar supported by posts and a bottom rail connected to each post, the crossbar, posts and bottom rail each being formed from two sections of tubing coupled with a straight connector, an elastic cord connecting the components of the frame, and a flexible mesh provided with sleeves for affixing the mesh to components of the frame, the sleeves being less flexible than the mesh and being wide enough to permit components of the frame to slide therein.

BRIEF DESCRIPTION OF THE DRAWINGS

In drawings which illustrate an example of a preferred embodiment of this invention.

FIG. 3 is a magnified cutaway view of the mesh and sleeve;

FIG. 4 is a perspective view of the goal net of FIG. 1 collapsed;

DETAILED DESCRIPTION OF THE INVENTION

Figure 1:
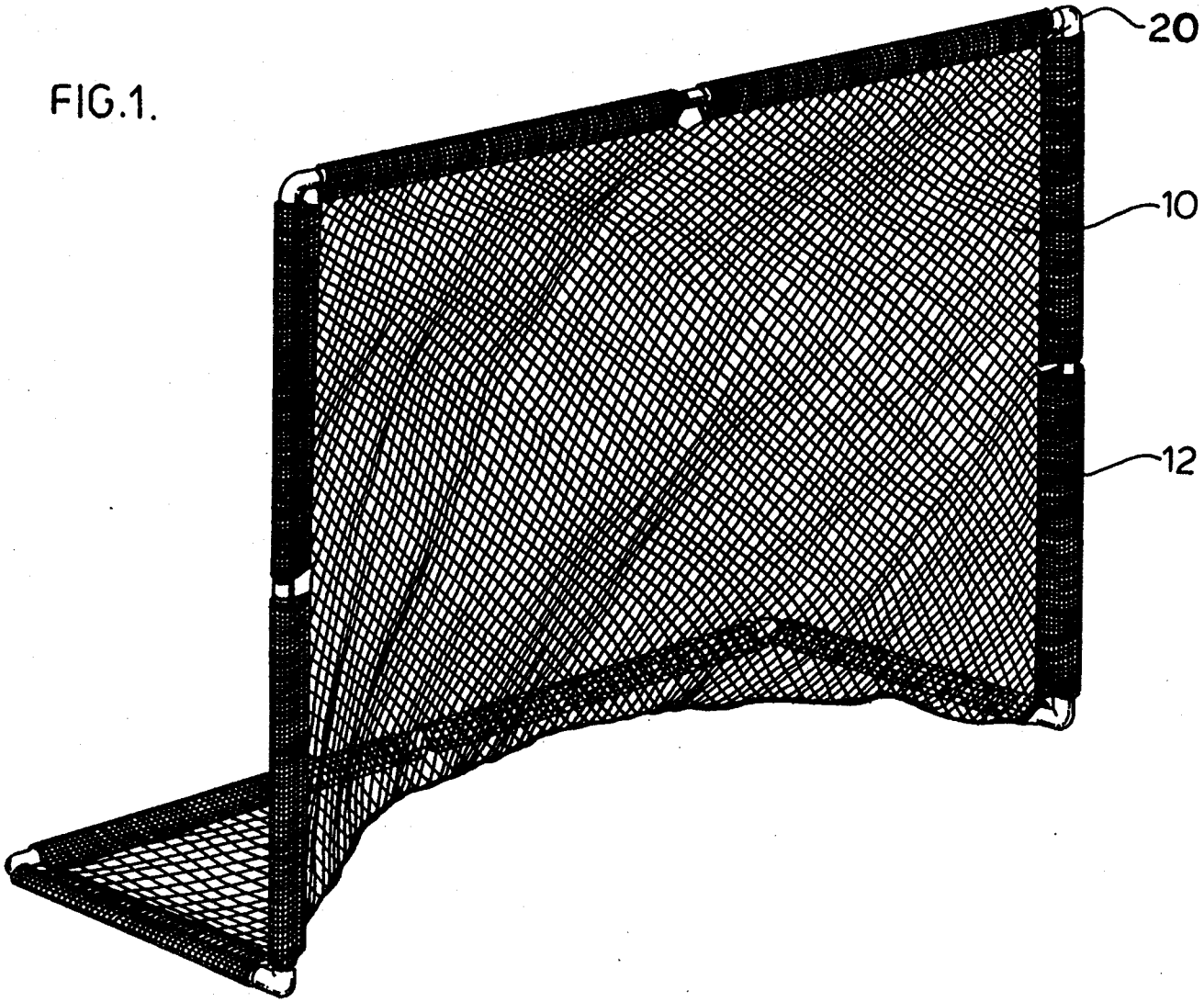
FIG. 1 is a perspective view of the erected goal net embodying the invention.

Referring to FIG. 1, the goal net consists of a mesh 10 attached to a tubular frame 20. The mesh 10 is flexible and durable, and is composed of any material sufficiently strong to withstand the force of an object, such as a hockey puck or ball, impelled against the mesh 10. The mesh 10 is conventionally sized to fit the frame 20. Stitched or otherwise affixed to the edges of the mesh 10 are sleeves 12.

The sleeves 12 are also composed of a flexible material, preferably a fine net or mesh of flexible plastic or nylon which is not as flexible as the mesh 10. The sleeves 12 are sufficiently large that the tubes of the frame 20 slide easily within the sleeves 12.

Figure 2:
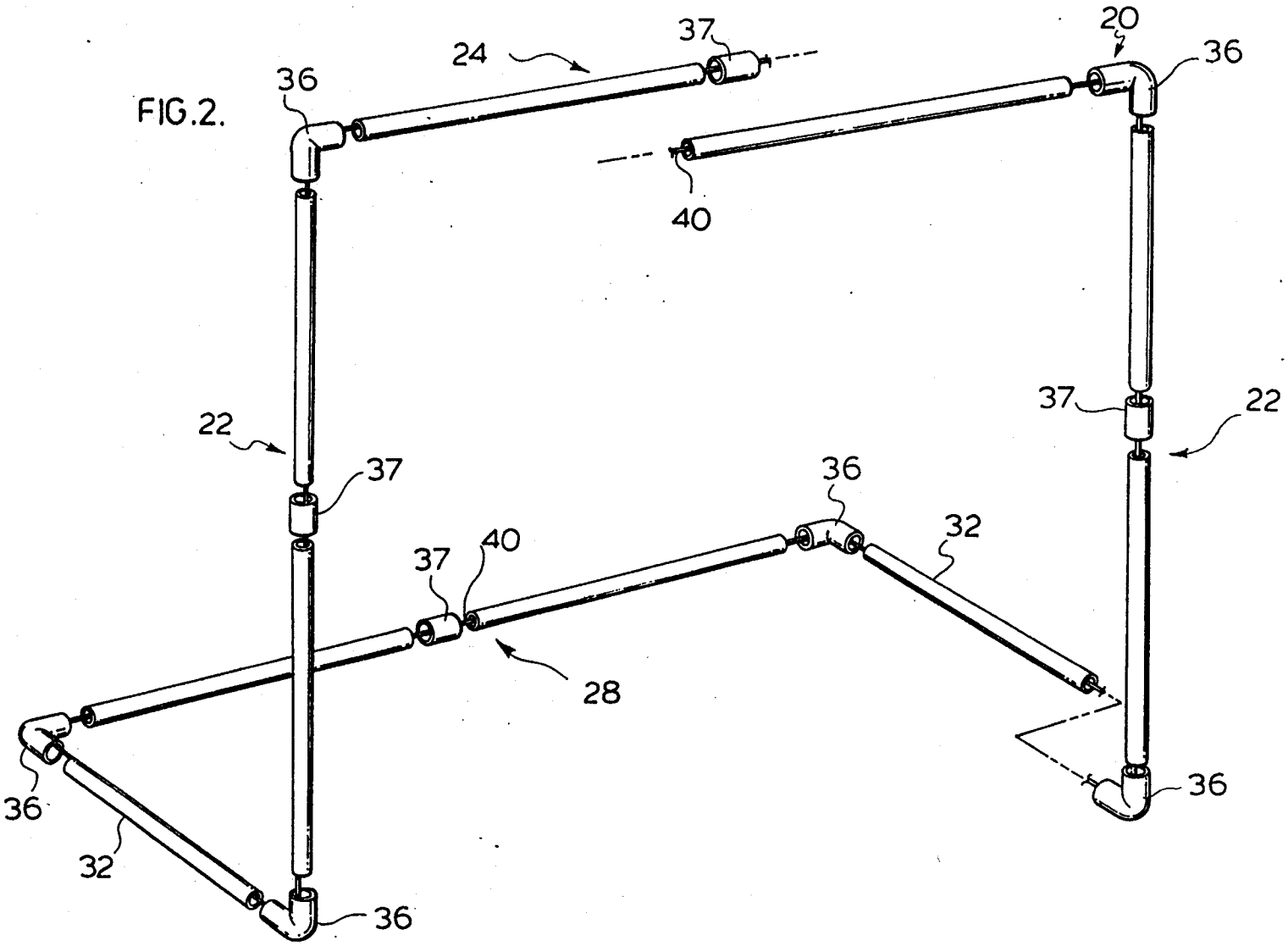
FIG. 2 is an exploded view of the frame for the goal net of FIG. 1.
Figure 5:
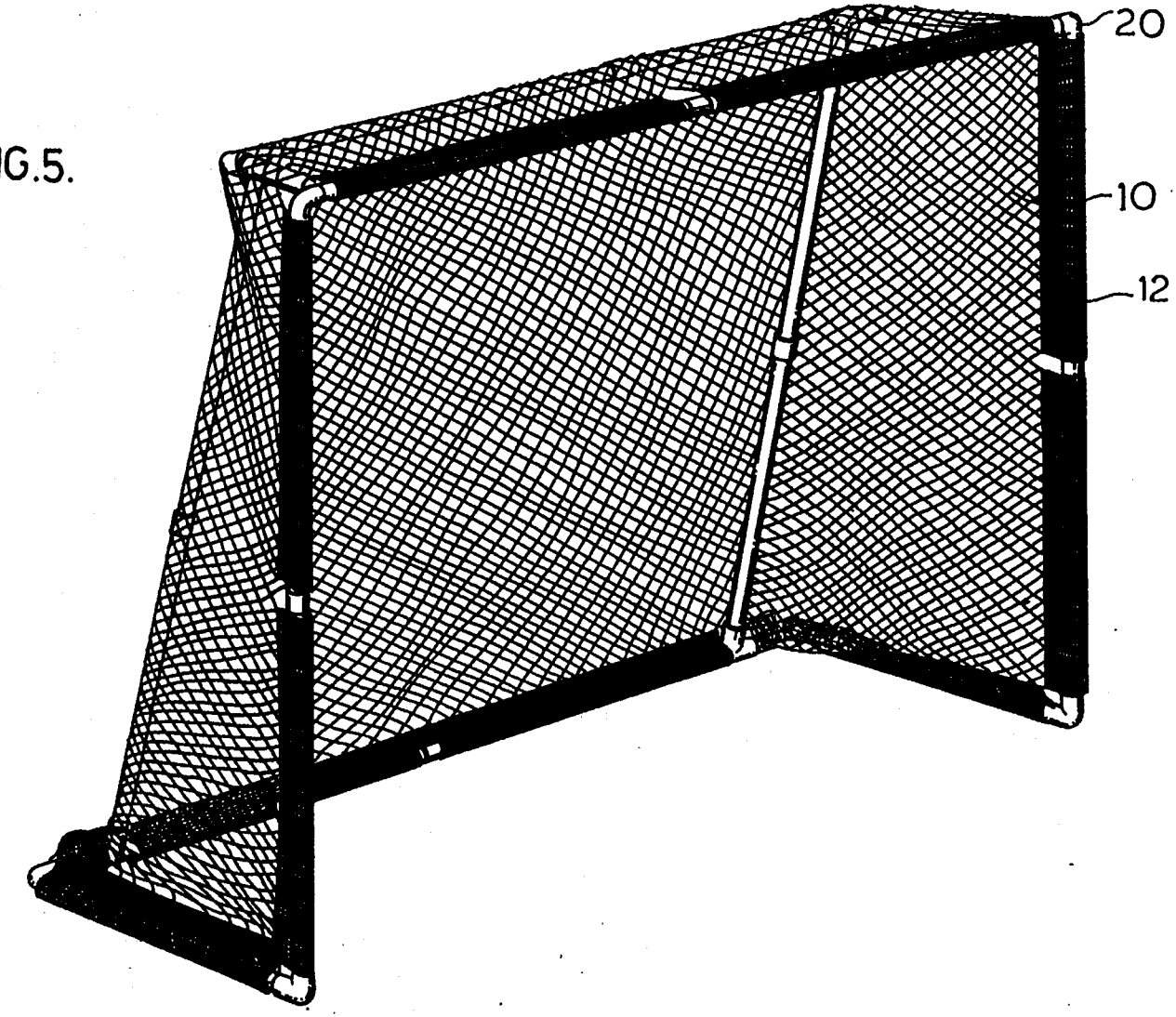
FIG. 5 is a perspective view of a goal net embodying a further preferred embodiment of the invention.
Figure 6:
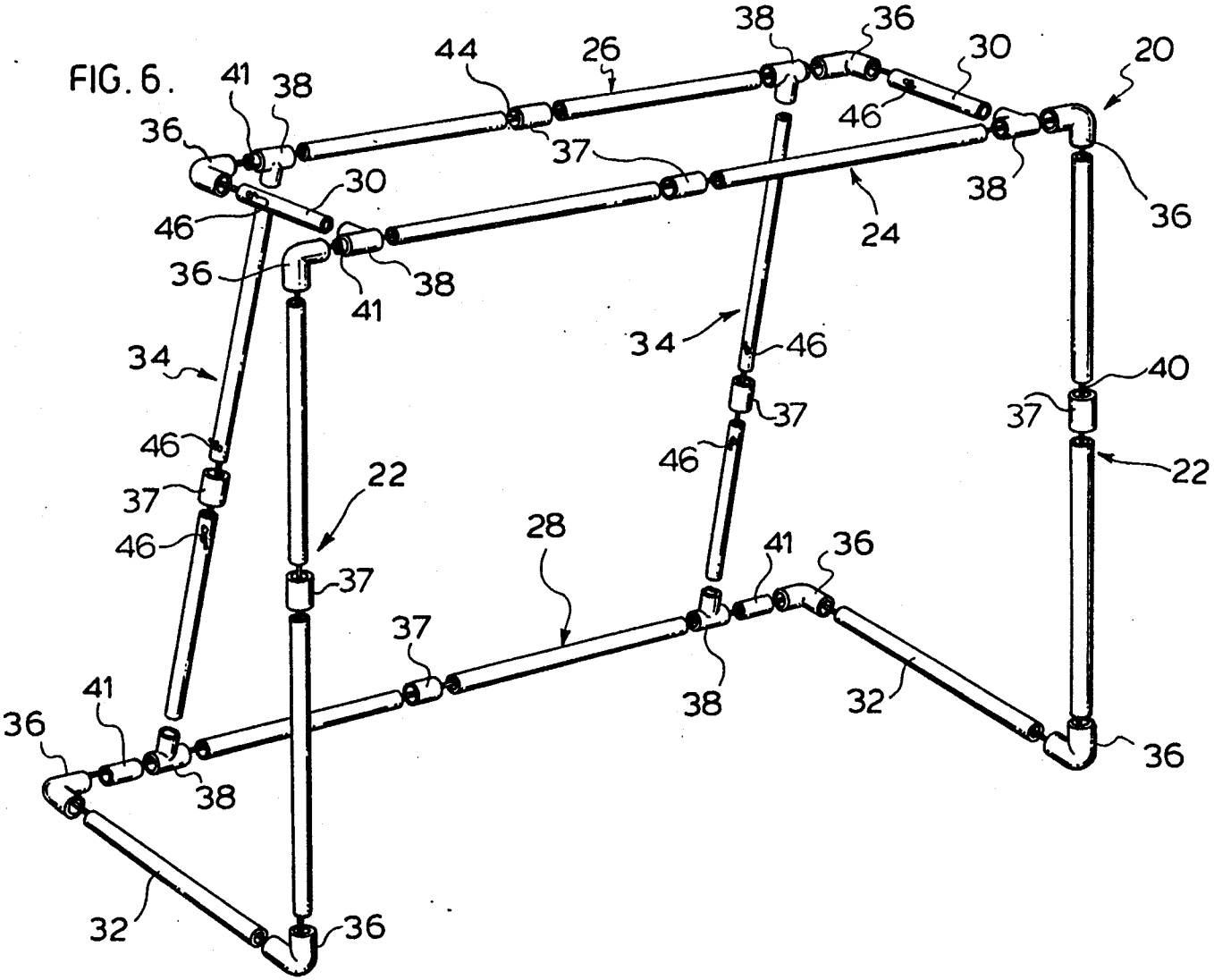
FIG. 6 is an exploded view of the frame for the goal net of FIG. 5.

The erected frame 20, composed of adjoining tubes of metal or another durable, rigid material such as plastic, can be seen in FIG. 2. The posts 22 support the crossbar 24 and together these form the entrance to the goal net. Bottom joining bars 32 connect the bottom rail 28 to the bottoms of the posts 22. As shown in FIGS. 5 and 6, optionally top joining bars 30 connect a top rail 26 to the tops of the posts 22, and the top rail 26 is supported at or near the level of the crossbar 24 by struts 34.

All components of the frame 20 except for the top and bottom joining bars 30, 32 are preferably formed from a pair of tubes coupled by a straight connector 37. In this fashion the longer components of the frame 20 can be uncoupled at their centres to form shorter lengths for greater portability. The joining bars 30, 32 are sufficiently short that each can be formed as an integral piece.

Corner connectors 36 couple the posts 22 to the bottom joining bars 32 and the crossbar 24 at generally right angles. The bottom rail 28 is similarly connected to the rear ends of the bottom joining bars 32, completing a frame to which the mesh 10 will be attached.

In the embodiment of FIGS. 5 and 6 a 'T' connector 38 is coupled to both ends of each strut 34 as shown, and to the top and bottom rails 26, 28. The remaining coupling of each 'T' connector 38 is coupled using a short length of tubing 41 (shown in FIG. 6) to corner connectors 36 coupled to the top and bottom joining bars 30, 32, respectively. The front ends of the top joining bars 22 are similarly coupled to 'T' connectors 38 coupled to the crossbar 24 and corner connectors 36 at the tops of the posts 22, again using a short length of tubing 41.

A single elastic cord 40 such as a BUNGEE (trademark) runs through the crossbar 24, posts 22, bottom joining bars 32 and bottom rail 28, and all connectors 36, 37, 38, and the free ends are tied together to form a continuous loop so that these components of the frame 20 cannot be completely detached from one another; adjoining components can be uncoupled so that the connections are no longer rigid, but a flexible connection is retained due to the presence of the elastic cord, to keep the components in the proper arrangement and thus facilitate erecting the frame.

If a top rail 26 is used, the struts 34 are each provided with their own piece of elastic cord 42 extending through a hole in each tube adjacent to their connectors 37, and the cord is knotted as at 46 to prevent its ends from slipping back into the struts 34. A fourth elastic cord 44 connects the top joining bars 30 to the top rail 26 in the same fashion. Thus, the frame of FIG. 6 can be knocked-down into four separate sections: the top rail 26 and top joining bars form one section, the two struts 34 each form a separate section, and the remaining components (the crossbar 24, posts 22, bottom joining bars 32 and bottom rail 28) form the main section. It is to the main section that the mesh 10 is affixed.

As noted above, the mesh 10 is conventionally dimensioned to fit the frame 20. However, it is not feasible to tie the mesh 10 to the frame 20 in a conventional fashion, because as the frame is collapsed or erected the mesh 10 itself, or any cord or string used to tie the mesh 10 to the frame 20, will become caught and entangled in the uncoupled joints of the frame. Accordingly, the edges of the mesh are provided with sleeves 12 which are composed of a material less flexible than the mesh 10, such as a fine net or mesh of flexible plastic or nylon.

Preferably a separate sleeve 12 is provided for each component of the frame 20. Thus, while only a single sleeve is provided to attach to each bottom joining bar 32, two sleeves 12 are provided to attach to each of the two piece frame members such as the crossbar 24, posts 22 and bottom rail 28. Each sleeve 12 is slightly shorter than the length of tube to which it is attached, and thus the sleeves 12 do not extend over the connectors 36,37 when erected; as can be seen in FIG. 1, some clearance is left between adjacent sleeves 12 at the point of each connector, to facilitate coupling and uncoupling the connectors 36, 37 when collapsing and erecting the frame 20. Each sleeve 12 must be wide enough to permit the tubes of the frame 20 to slide easily within the sleeve 12, as best seen in FIG. 3. The lesser flexibility and tighter weave of the sleeves 12 helps to prevent their becoming caught on uncoupled joints.

The goal net of FIG. 1 is collapsed to the form of FIG. 4 by uncoupling the components from each straight connector 37 and corner connector 36. In the embodiment of FIGS. 5–6, the struts 34 are first removed from the erected goal net by uncoupling each end from its 'T' connector 38. One tube of each strut 34 is then uncoupled from the straight connector 37, and the strut 34 is folded at the resulting flexible joint. The top joining bars 30 are then uncoupled from their 'T' connectors 38 and are removed with the top rail 26, which is uncoupled at its centre and folded at the resulting flexible joint. The top joining bars 30 may also be uncoupled from the top rail 26 to reduce the size of the collapsed section. At this point the goal net is completely collapsed, with the sleeves 12 of the mesh 10 still attached to the frame 20, and can be placed in a nylon bag (not shown) or another convenient container (with the top rail 26, top joining bars 30 and struts 34, if used) for transport or storage.

To erect the goal net, this process is followed in reverse. For the embodiment of FIGS. 5–6, once the main section (to which the mesh 10 is affixed) has been assembled, the top joining bars 30 can be assembled to the top rail 26 and inserted into their 'T' connectors 38, and then swung upwardly into place to tension the mesh 10, following which the struts 34 are inserted to support the top rail 26. It is thus advantageous if the short connecting tube 41 is not glued, or is glued only at one end, so that 'T' connectors 38 to which the crossbar 24 connects can rotate relative to the immediately adjacent corner connectors 36. Of course, all connectors 36, 37, 38 must be detachable in order to permit uncoupling of adjacent components. The tension in the mesh 10 keeps the components of the erected frame 20 from becoming uncoupled during use.

The goal net may be sold with frame components already flexibly attached with the cord 40, or may be sold as a kit which can be assembled by the purchaser. In either case, once the elastic cord 40 has been tied within the components of the frame, the resulting frame components retain their predetermined arrangement and remain flexibly connected, whether the net is erected or collapsed.

Embodiments of the invention having been described by way of example only, it will be apparent to those skilled in the art that certain modifications or adaptations may be made without departing from the scope of the invention. The specific connectors and tubular components described are for purposes of illustration and do not detract from the scope of the invention as set out in the appended claims.

We claim:

1. A collapsible hockey goal net comprising a frame having components comprising a crossbar supported by posts and a bottom rail connected to each post, one or more components of the frame being comprised of two tubes being detachably coupled together, and a mesh provided along its peripheral edges with sleeves into which components of the frame are slidably received, a separate sleeve being provided for each component of the frame to which the mesh attaches with a clearance being provided between adjacent sleeves to facilitate coupling and uncoupling of connectors between frame components, the sleeves being composed of a material which is less flexible than the mesh and having a tighter weave than the mesh, and being wide enough to permit the components of the frame to slide freely within the sleeves, whereby adjoining components of the frame are rigidly connected when coupled together and can be uncoupled to collapse the goal net.

2. The goal net of claim 1 wherein components of the frame are connected by an elastic cord.

3. The goal net of claim 1 including a top rail supported on the bottom rail by struts.

4. The goal net of claim 3 wherein the top rail is detachably connected to the crossbar or the posts.

5. The goal net of claim 2 wherein the crossbar, posts and bottom rail are connected by a single elastic cord.

6. A kit of parts for constructing a hockey goal net, including frame components comprising a crossbar, posts and a bottom rail for forming a frame, a mesh provided along its peripheral edges with sleeves sized to fit over components of the frame, a separate sleeve being provided for each component of the frame to which the mesh attaches with a clearance being provided between adjacent sleeves to facilitate coupling and uncoupling of connectors between frame components, the sleeves being composed of a material which is less flexible than the mesh and having a tighter weave than the mesh, and being wide enough to permit components of the frame to slide freely within the sleeves, one or more components of the frame being comprised of two parts detachably coupled together.

7. The goal net of claim 6 wherein components of the frame are connected by an elastic cord.

8. The goal net of claim 6 including a top rail and struts.

9. A collapsible goal net comprising a frame having frame components comprising a crossbar supported by posts and a bottom rail connected to each post, the crossbar, posts and bottom rail each being formed from two sections of tubing coupled with a straight connector, and a flexible mesh provided with sleeves for affixing the mesh to components of the frame, a separate sleeve being provided for each component of the frame to which the mesh attaches with a clearance provided between adjacent sleeves to facilitate coupling and uncoupling of frame components, the sleeves being less flexible than the mesh and having a tighter weave than the mesh and being wide enough to permit components of the frame to slide therein.

10. The goal net of claim 9 including a top rail supported on the bottom rail by struts.

11. The goal net of claim 10 wherein the top rail is connected to the crossbar or the posts.

12. The goal net of claim 11 wherein the top rail contains a cord secured to top joining bars.

13. The goal net of claim 9 wherein the crossbar, posts and bottom rail are connected by an elastic cord.

* * * * *